United States Patent [19]

Berggren

[11] 4,286,512

[45] Sep. 1, 1981

[54] SCREW-PRESS

[76] Inventor: Torsten L. Berggren, Rosenlidsgatan 13, S-571 00 Nässjö, Sweden

[21] Appl. No.: 45,951

[22] Filed: Jun. 6, 1979

[30] Foreign Application Priority Data

Jun. 14, 1978 [SE] Sweden ..... 7806848

[51] Int. Cl.[3] ..... B30B 9/12

[52] U.S. Cl. ..... 100/74; 100/112; 100/117; 100/127

[58] Field of Search ..... 100/73, 74, 112, 117, 100/126, 127

[56] References Cited

U.S. PATENT DOCUMENTS 239,222 3/1881 Burgess ..... 100/117

FOREIGN PATENT DOCUMENTS 2641597 3/1978 Fed. Rep. of Germany ..... 100/117
751551 9/1933 France ..... 100/117
1127727 9/1968 United Kingdom ..... 100/117

*Primary Examiner*—Billy J. Wilhite

*Attorney, Agent, or Firm*—Frishauf, Holtz, Goodman and Woodward

[57] ABSTRACT

A screw press for pressing liquid from fibrous slurries, such as paper pulp, sludge, sedimentation and like material, in which the material is fed into the press at one end of a press screw arranged within a cylindrical strainer drum and rotatable about its longitudinal axis, and fed out of the press through a discharge zone located at the other end of said screw. The core of the screw has a successively increasing diameter along the major part of its length such that the space defined between the core and the wall of the drum gradually decreases in the feed direction. According to the invention the drum is arranged to rotate at a speed which differs from the speed of rotation of the screw. The speed of rotation of the drum is so selected that there is obtained, as the result of the centrifugal force, an effective draining through the drum of free liquid present in the slurry and liquid pressed from said slurry due to the action of the press-screw. Preferably, the press is provided with means for introducing washing liquid in at least one stage for the purpose of washing material introduced into the press.

7 Claims, 7 Drawing Figures

4
5
34
7
33
36
16
35
B
6
17
18
17
32
21
20
23
19
21

24
47
43
46
45
26
29
28
27
30
25
8
44
51
50
48
49

SCREW-PRESS

BACKGROUND OF THE INVENTION

The present invention relates to a screw press intended for pressing liquid from fibrous slurries, such as paper pulp, sludge obtained from communal and industrial sewage works, suspensions of secondary paper and the like, optionally in conjunction with a washing operation. To this end, the screw press is of the kind in which the material is fed into the press at one end of a press screw arranged within a cylindrical strainer drum and rotatable about its longitudinal axis, and fed out of the press through a discharge zone located at the opposite end of the screw, the core of said screw having a successively increasing diameter along a major part of its length such that the space defined between said core and the wall of said drum gradually decreases in the feed direction, in order to exert a pressing force on the material advanced by the screw.

Simple dewatering and dewatering in combination with pressing are applied, for example, when producing paper pulp, where, during the process, the fibre material is diluted several times with water or caustic liquor, e.g. for screening, bleaching, washing purposes etc., the liquid being pressed out of the material between each such diluting operation. Fibrous sludge obtained from communal and industrial purification works is dewatered and pressed to reduce its weight prior to being transported for destruction or storage.

These processes are, today, effected by means of conventional apparatus, such as drum dewaterers, suction filters, screw-presses, screw dewaterers, disc presses, roller presses and centrifugal devices. Common disadvantages with these apparatus are that they are expensive, large and bulky and that they require a lot of energy for their operation.

Dewatering operations undertaken in combination with washing operations is applied, for example, in the manufacture of semi-chemical and chemical pulp, in which the cooking liquor, subsequent to the digestion stage, contains organic and inorganic substances. These substances must be removed and in the majority of cases are subjected to vaporization and combustion processes in order to recover the heat content of the wood substances dissolved therein and to enable the cooking chemicals to be re-used. To this end, the pulp is separated from the cooking liquor, suitably by means of a washing process. Washing of the pulp from the cooking liquor should be as complete as possible and still be carried out with a minimum dilution. Washing is also necessary from the aspect of environmental care, since excessively high contents of chemicals in the waste water contaminates the water ways, while organic constituents have the drawback that they consume oxygen.

Normally, the aforementioned working operations are, today, effected by means of rotary suction filters having a washing zone, continuous diffusors and washing presses in which the material is compacted in combination with the pressing thereof. These apparatus require an even greater investment than do apparatus for simple dewatering operations. This means, inter alia, that it is not economically justifiable to manufacture such apparatus below a certain size and below a certain minimum capacity. Because of this, the demand is limited in respect of small factories or factories of average size which require apparatus of a smaller size.

A conventional, simple, dewatering screw-press also has the disadvantage that its dewatering capacity is low, primarily at the inlet end of the press where the slurry is of low concentration and thus large quantities of liquid must be drained off. Tests have shown that, inter alia, only a small number of the holes in the draining drum operate effectively, and hence the dewaterer must be given unnecessarily large dimensions in order to obtain a given capacity. Furthermore, the possibilities of regulating the said capacity and the outgoing dryness of the pulp are relatively limited, and hence this type of dewatering apparatus has not been found suitable for dewatering the material in combination with the washing thereof.

SUMMARY OF THE INVENTION

The present invention is based on the concept that the dewatering capacity of a conventional dewatering screw-press can be greatly increased when the normal dewatering process, with draining and pressing, is combined with an efficient draining of free liquid present in the slurry and the liquid pressed out therefrom due to the action of the press-screw. This is achieved in accordance with the invention by also causing the drum to rotate, by means of which the centrifugal force acting on the free or extracted liquid produces an effective drainage thereof through the perforated walls of the drum. The speed at which the drum rotates and/or its direction of rotation shall differ from the speed or direction of rotation of the press-screw.

The speed at which the drum rotates shall only be as high as that required for the centrifugal force to act effectively on the free water or extracted water in the slurry, while the water bound with the material is pressed out therefrom as a result of the pressing action obtained by the conical shape of the screw. Thus, the present invention shall not be compared with a centrifugal-type dewatering apparatus, in which a drainage drum is rotated at a speed of such magnitude that the water bound in the material is also removed therefrom as a result of the centrifugal force thus created. Such apparatus also exhibit among other things the aforementioned disadvantages of high manufacturing costs and high operational costs.

For the purpose of obtaining the best centrifugal effect, it is preferred that the drum rotates in the same direction as the press screw and at a higher speed than said screw. Suitably, the speed of rotation of the press screw and the drum is continuously regulatable independently of one another. The rotary speed of the drum which is less than 500 rpm and preferably within a range of 100–250 rpm, determines the draining effect, while the difference in the rotary speed of the drum and the press-screw determines the feed speed of the material.

To provide for effective washing of the material in the screw press, it is proposed that the core of the press screw is provided with distribution channels for washing liquid, said channels discharging into peripheral slots in the outer wall of the core. Adjacent each of said slots, the outer wall is suitably provided with a step-shaped clearance surface for enabling washing liquid to be effectively introduced into the material.

DETAILED DESCRIPTION

Figure 1:
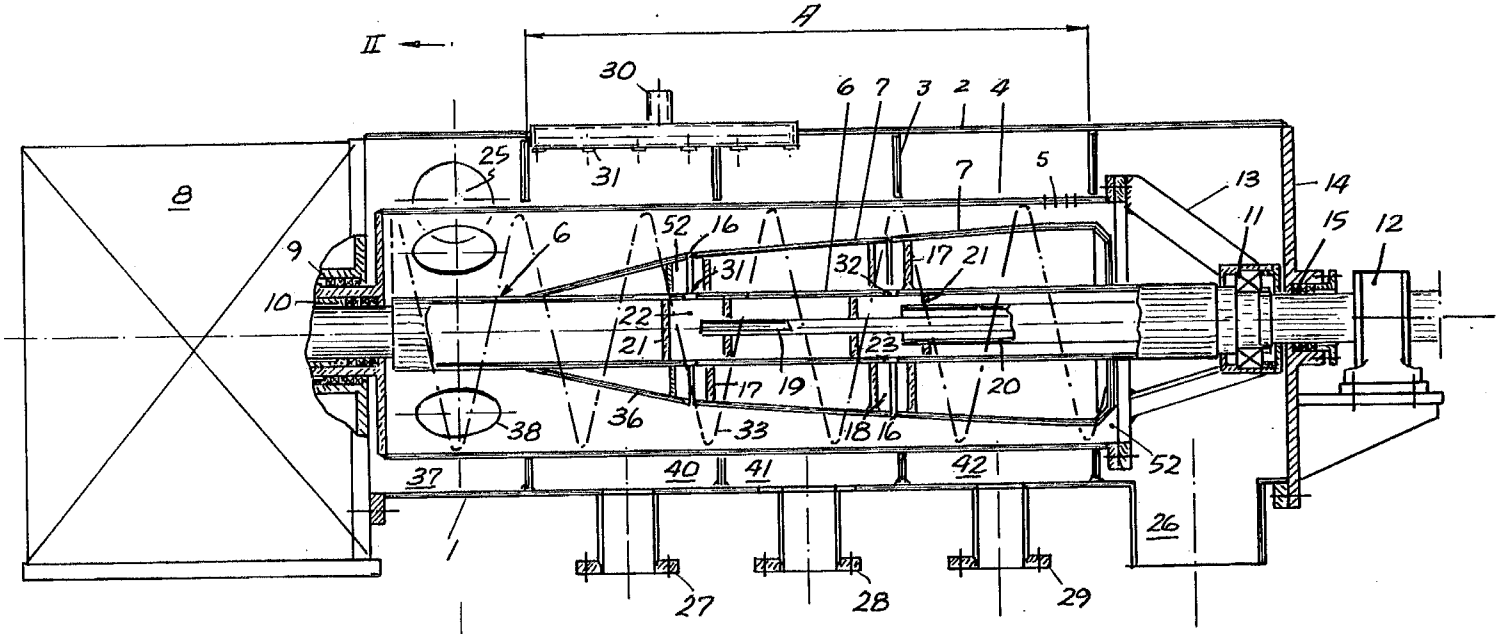
FIG. 1 is a side view, partly in section, of a dewatering screw-press according to the invention, having two mutually separated washing zones.
Figure 2:
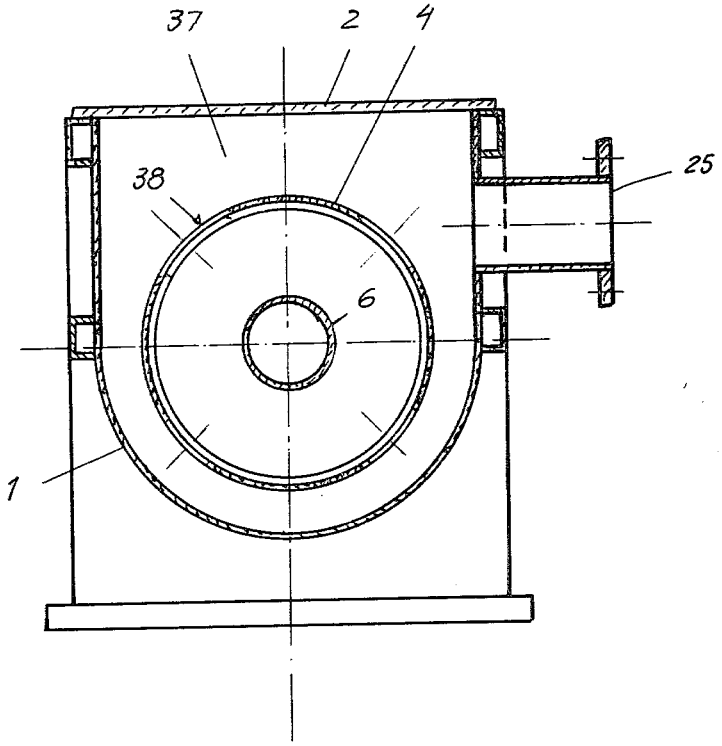
FIG. 2 is a cross sectional view taken on the line II-II in FIG. 1.

The screw-press illustrated in FIGS. 1 and 2 comprises a trough-shaped outer casing 1 having a sealingly closed lid 2. The trough 1 is divided into chambers by means of partitions 3. The partitions 3 are provided with rubber seals which seal against a rotatable draining drum 4, said drum being perforated with conical holes 5, see FIG. 3, over a distance extending between a forward partition wall and a rearward partition wall, said distance being referenced A in FIG. 1. The normal diameter of the holes 5 is from 1–3 mm, the holes having a conical clearance outwardly of about 5°–10°, see FIG. 3. A press-screw arranged for rotation in the drum 4 comprises a central tube 6 and a conical core 7. The screw may be provided with a single helix or a double helix 33. Both the screw and the drum are rotatable independently of one another and are journalled at their respective ends in a bearing and operating unit 8, not shown in detail. Conventional stuffing or sealing boxes 9 and 10 are provided for sealing against the rotatable shafts of the screw and the drum. The drum is journalled at the outlet side of the press in a conventional bearing 11 and the screw in a pillow block 12. Arranged between the drum and the bearing 11 are three connecting arms 13. A conventional stuffing box 15 is provided for sealing against the wall 14. The unit 8 is arranged to provide continuous regulation of the rotary speeds of the drum and the press screw independently of one another, for the purpose of changing the difference in the speed of rotation therebetween.

Figure 1A:
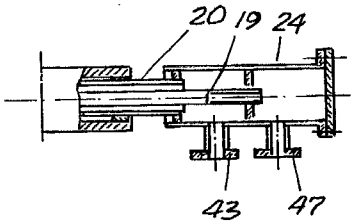
FIG. 1*a* is a sectional view of an element of the press according to FIG. 1.

The core 7 of the press-screw is provided with two circumferentially extending slots 16 and four partitions 17. The partitions 17 serve as supports for the core and define two chambers 18 and 52 between the center tube 6 of the press-screw and the core 7, through which chambers washing liquid can be introduced into the material being treated. To this end, the center tube 6 of the press-screw is provided with two distributing pipes 19 and 20 which are supported in the center tube by means of partitions 21, which also define two mutually separate chambers 22 and 23 for distributing the washing liquid. The washing liquid is supplied to the distributing pipes 19 and 20 by means of a conventional, rotary sealing box 24, as shown in FIG. 1*a*. The sealing box 24 is provided with two inlets 43 and 47 for respective pipes 20 and 19.

Figure 3:
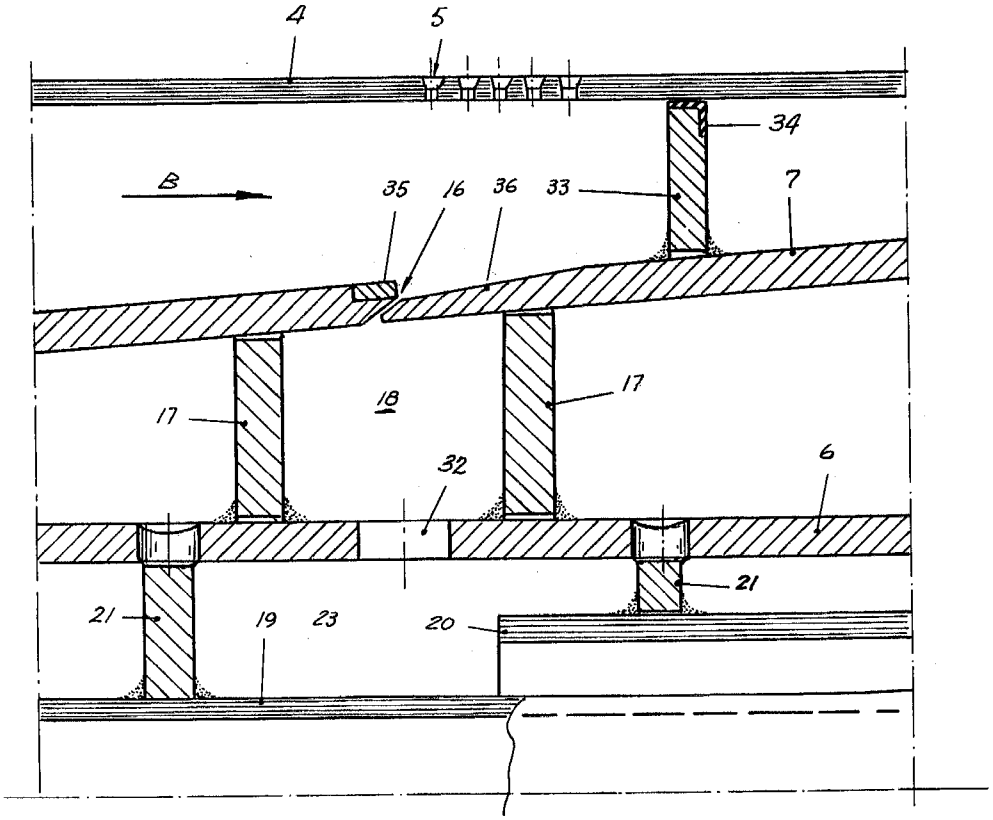
FIG. 3 illustrates a part of the press shown in FIG. 1 in larger scale.

FIG. 3 illustrates the chamber 18 and the surrounding elements in a larger scale. The screw helix 33 is illustrated in section, it being shown that said helix is provided with a coating 34 of a wear-resistant material. The outer wall of the conical core 7 of the press-screw is provided with a step-like clearance surface adjacent the slot 16, to enable washing liquid to be effectively introduced into the material in the press, said material moving in the direction of the arrow B. When the material passes over the lip 35 coated with said wear-resistant material, a cavity is created in the body of the material being advanced, said cavity facilitating the penetration of washing liquid into said material, which material is able to expand somewhat at this location. As a result of the overpressure on the liquid in the chamber 18 and the centrifugal force obtained by rotation of the drum 4, the washing liquid effectively penetrates the said material, to be later drained out through the holes 5 in the drum 4.

When the screw-press illustrated in FIGS. 1–3 is in operation, the pulp to be dewatered and washed is fed by means of a pump or a screw conveyor in through the stub pipe 25 in the side wall of the trough 1, and further into a chamber 37 located between the trough 1 and the drum 4. The pulp then passes through holes 38 in the rear part of the drum and is entrained by the helix 33. Since the drum 4 also rotates, the pulp suspension is subjected to a centrifugal force, which causes free water present in the pulp suspension to be effectively drained off.

For the purpose of preventing the holes 5 in the drum 4 from becoming blocked by fibres and like material, a spray pipe 30 (FIG. 1) is arranged on the upper side of the trough 1. The pipe 30 includes a plurality of nozzles 31 which direct a strong, flat jet of liquid onto the shell of the drum, said jet of liquid preventing the holes 5 from becoming blocked.

Thus, the pulp suspension is advanced in the drum during progressive thickening of the pulp. When the suspension reaches the conical part 36 of the screw core 7, dewatering of the pulp becomes more effective, owing to the fact that, in addition to the centrifugal force, the pulp is also heavily compressed in the radial direction. This compression results in liquid bound in the fibre suspension being pressed out thereof, which water is effectively drained off as a result of the rotation of the drum 4.

Figure 4:
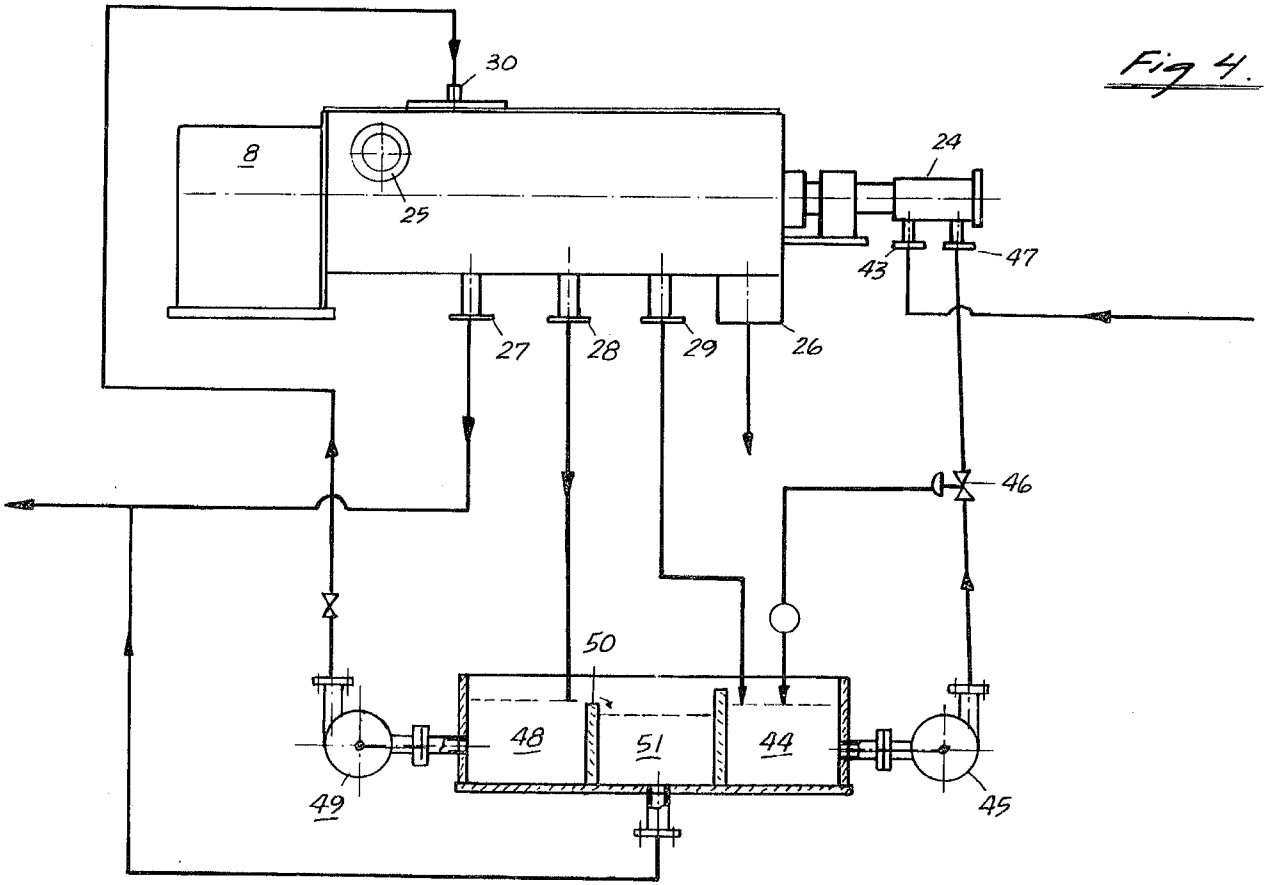
FIG. 4 illustrates schematically the operational made of a dewatering screw-press according to FIG. 1.

The washing process will be explained hereinafter with reference also to FIG. 4. Pure washing water is supplied to the sealing box 24 via the pipe stub 43, and passes through the distribution pipe 20 (FIG. 1), the chamber 23, holes 32, the chamber 18 and out through the slot 16. The washing liquid passes herefrom successively through the material being treated and out through the holes 5 in the shell of the drum 4, to a chamber 42. The water is led from the chamber 42 to a container 44 (FIG. 4), via a line connected to the pipe stub 29. The washing liquid, which is now slightly contaminated, is pumped from the container 44 to the pipe stub 47 of the sealing box 24 by means of a pump 45 and under the control of a level-control means 46, and passes from the pipe stub 47 through the distributing pipe 19 (FIG. 1), the chamber 22, holes 31, the chamber 52, the slot 16, the holes 5, a chamber 41 and a line connected to the pipe stub 28 to a further container 48.

The washing liquid in the container 48 is fed to the spray pipe 30 by means of a pump 49. Surplus liquid runs over a weir 50 to a container 51 and is passed to a purifying system, together with a liquid obtained from a first section 40 in the trough via a pipe stub 27.

The annular body of pulp located between the screw-core 7 and the inner drum wall is thus conveyed forwardly in the press-screw by means of the helix 33 and is dewatered and washed successively in accordance with the aforedescribed process. As a result of the decreasing area of the gap between the core and the drum wall, the fibre body is progressively compressed and dry contents within the range of 15–50% can be obtained at the outlet 52. The fibre body discharged at the outlet 52 falls down through the pipe stub 26 and is conveyed away from the apparatus by means of a screw conveyor or a thick pulp pump.

When washing sulphate pulp, where the medium is sensitive to the incorporating air therein, the washing system according to the aforegoing may also have the form of a completely sealed system. The number of washing stages can be varied, as desired.

The use of peripheral or circumferential slots 16 for introducing the washing liquid into the material, and the provision of a clearance or relief surface at the cylindrical surface of the core 7 of the conical screw adjacent each slot results in considerably lower friction between the screw and press material, in comparison for example with a perforated screw core, and facilitates penetration of the washing liquid into the pulp layer, since the pulp layer, which is homogenous in other respects, has a tendency to crack at the surface thereof during its passage over the lip 35.

Figure 5:
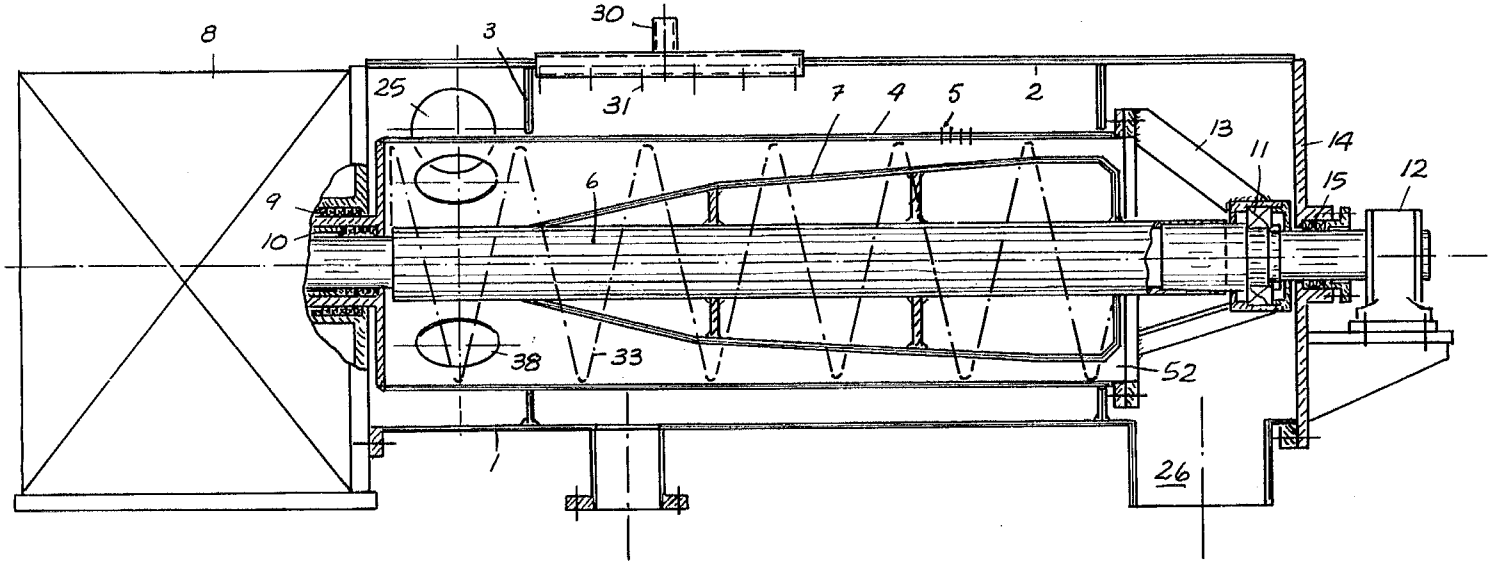
FIG. 5 is a side view, partly in section, of a dewatering screw-press according to the invention for simple dewatering of material, i.e. without washing zones.

The invention can also be used for simple dewatering and pressing of the pulp, in the absence of a washing function. In this case the apparatus is in principle similar to the previously described apparatus, although the special arrangements for introducing and distributing washing liquid are not included. An embodiment of an apparatus for the simple dewatering and pressing of pulp concentrations is illustrated in FIG. 5. A detailed description of this apparatus is considered unnecessary, since it coincides completely with the apparatus illustrated in FIG. 1 with the exception of the above mentioned differences.

Figure 6:
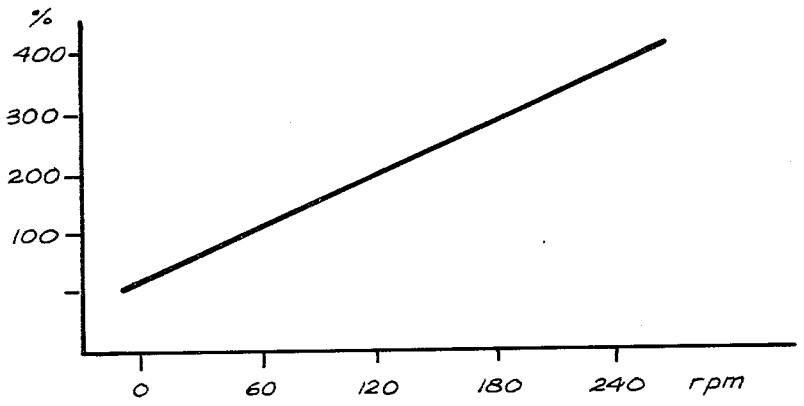
FIG. 6 shows a capacity curve of a dewatering screw-press according to the invention.

As beforementioned, the draining effect created by the centrifugal force on the free liquid in the pulp or the liquid released therefrom is determined with both the apparatus according to FIG. 1 and that according to FIG. 5 by the speed at which the drum rotates, said liquid being drained out through the holes in the drum 4. The speed at which the material is advanced is determined, inter alia, by the difference in the rotary speed of the drum 4 and of the press-screw 33. It is preferred that both the drum and the press-screw rotate in one and the same direction, and in order to obtain the best draining effect the drum should rotate at a higher speed than the press-screw. When carrying out dewatering tests on a paperpulp having a freeness of 30° SR and a concentration of about 3% at the inlet, there was obtained at an output concentration of 20% a capacity curve according to FIG. 6, which illustrates the increase in capacity in percent as a function of the speed at which the drum rotates. It will be seen, inter alia, that when the drum rotates at a speed of 240 rpm (diameter 500 mm) the capacity was five times greater than the capacity obtained with a stationary drum. It is preferred that the drum rotates at a speed of 100–250 rpm. If the drum is arranged to rotate more slowly than the press-screw, the pitch of the screw must be changed. When only a low dewatering capacity is required, the screw and the drum may be arranged to rotate in mutually different directions.

With respect to the function of dewatering and dewatering combined with pressing, an apparatus constructed in accordance with the invention requires, inter alia, much smaller dimensions and is much easier to operate than a conventional apparatus of the same capacity, and therewith the investment required is normally about 50% lower.

What is claimed is:

1. A screw-press for pressing liquid from fibrous slurries, such as paper pulp, sludge, sedimentation and like material, comprising:

a cylindrical perforated strainer drum;

a press screw arranged within said cylindrical strainer drum with a space therebetween and being rotatable about its longitudinal axis, said material being fed into the press at one end of said press screw and being fed out of the press through a discharge zone located at the other end of said press screw;

said press screw having a core with an outer wall which has a successively increasing diameter along the major part of its length such that a space defined between said core and the wall of said strainer drum gradually decreases in the feed direction of the material;

said strainer drum being rotatable about said longitudinal axis, at least one of the speed of rotation of said strainer drum and the direction of rotation of said strainer drum differing from the speed of rotation and the direction of rotation of said press screw, and wherein the speed of rotation of the strainer drum is so selected to produce a centrifugal force of given magnitude such that as the result of said centrifugal force, there is obtained an effective draining through said perforations of said strainer drum of free liquid present in the slurry and liquid pressed from said slurry due to the action of said press screw; and means for introducing washing liquid into at least a portion of the space between said press screw and said strainer drum, said portion comprising a stage of said screw press, for the purpose of washing the material introduced into said press, said means for introducing washing liquid including distribution channels in said core for the washing liquid, and peripheral slots in the outer wall of said core, said distribution channels discharging into said peripheral slots, said washing liquid being drained off together with other free liquid present in the slurry through said perforations of said strainer drum.

2. A press according to claim 1, wherein said strainer drum is rotated in the same direction as said press screw.

3. A press according to claim 2, wherein said strainer drum is rotated at a higher speed than said press screw.

4. A press according to claim 1, wherein the rotary speed of said screw and the rotary speed of said strainer drum are continuously regulatable independently of one another.

5. A press according to claim 1, wherein the speed of rotation of said strainer drum is less than 500 rpm.

6. A press according to claim 1, wherein the outer wall of the core, adjacent each of said slots is provided with a step like relief surface, which permits effective introduction of washing liquid into the material.

7. A press according to claim 1, wherein the speed of rotation of said strainer drum is within the range of from about 100 rpm to about 250 rpm.

* * * * *